US006996988B1

(12) United States Patent
Bussard

(10) Patent No.: US 6,996,988 B1
(45) Date of Patent: Feb. 14, 2006

(54) AUTOSOLAR THERMAL ELECTRIC CONVERSION (ASTEC) SOLAR POWER SYSTEM

(75) Inventor: Robert W. Bussard, Santa Fe, NM (US)

(73) Assignee: EMC2, San Diego, CA (US)

( * ) Notice: Subject to any disclaimer, the term of this patent is extended or adjusted under 35 U.S.C. 154(b) by 0 days.

(21) Appl. No.: 10/767,416

(22) Filed: Jan. 28, 2004

Related U.S. Application Data

(60) Provisional application No. 60/443,296, filed on Jan. 28, 2003.

(51) Int. Cl.
*B60K 16/00* (2006.01)

(52) U.S. Cl. ..... 60/641.8; 60/641.15

(58) Field of Classification Search ..... 60/641.8, 60/641.9, 641.11, 641.12, 641.14, 641.15
See application file for complete search history.

(56) References Cited

U.S. PATENT DOCUMENTS 4,064,867 A * 12/1977 Schlesinger ..... 126/587
4,134,273 A * 1/1979 Brautigam ..... 62/141
4,153,104 A * 5/1979 Ruder ..... 165/48.2
4,326,388 A * 4/1982 McFee ..... 62/324.6
4,402,188 A * 9/1983 Skala ..... 62/56
4,438,630 A * 3/1984 Rowe ..... 60/676
4,506,508 A * 3/1985 Coers et al. ..... 60/652

* cited by examiner

*Primary Examiner*—Hoang Nguyen
(74) *Attorney, Agent, or Firm*—Foley & Lardner LLP

(57) ABSTRACT

A thermal collection system has a first tank for storing relatively hot working fluid and a second tank for storing relatively cold working fluid. A heat exchanger is connected for receiving the relatively hot working fluid from the first tank for providing heat to the heat exchanger. The heat exchanger discharges the working fluid at a lower temperature than a temperature of the relatively hot working fluid of the first tank. A solar panel collector is connected for receiving the lower temperature working fluid from the heat exchanger and for heating the lower temperature working fluid and feeding same to a first control valve. The first control valve is operative for feeding working fluid from the solar collector selectively to one of the first tank and the second tank. The second tank has a second control valve selectively operative for permitting working fluid from the second tank to flow to the solar collector. Improved collection efficiencies in the solar collector may be obtained using the two tank structure for passing working fluid through the solar collector.

32 Claims, 14 Drawing Sheets

AutoSolar Collector

FIG. 12
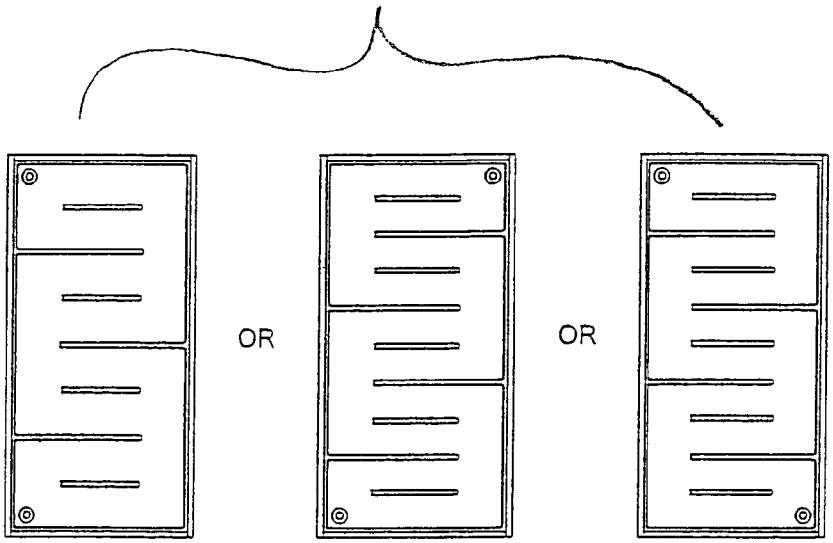
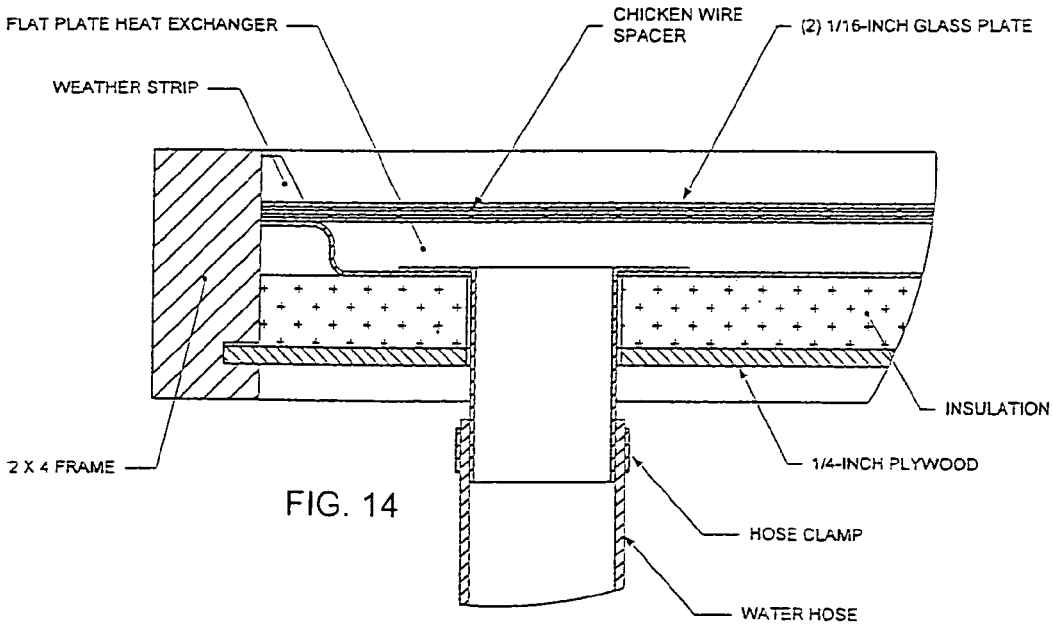
FIG. 14

Collector Cross Section A-A

AUTOSOLAR THERMAL ELECTRIC CONVERSION (ASTEC) SOLAR POWER SYSTEM

CROSS REFERENCE TO RELATED APPLICATION

This application claims benefit under 37 C.F.R. §119 (e) of U.S. provisional Application Ser. No. 60/443,296 filed Jan. 28, 2003, the entire contents of which is incorporated herein by reference.

BACKGROUND OF THE INVENTION

Billions of dollars have been spent in solar energy R&D, and tens of thousands of solar energy devices and systems have been built, sold, and installed across the US. All have been inherently so expensive that they have been cost-supported by tax relief schemes or rebates, and all are utterly unable to compete economically with conventional power plants and heat-power systems. The result of these billions of dollars of R&D is that these solar power systems can NOT provide low-cost power to the consumers of this or any other Nation.

This failure of solar power R&D to yield useful systems is precisely because it was conducted as R&D, not as construction of systems from available low-cost heat-power machinery. The excessive cost of all past solar power systems is a direct result of this struggle to develop and employ equipment and systems of advanced high technical performance.

SUMMARY OF THE INVENTION

In accordance with principles of embodiments of the invention, solar power can be made inexpensively, but not with high-tech R&D products, but rather by use of proven, reliable heat-power equipment and devices which are mass-manufactured in the tens of millions by the US automotive, air conditioning and refrigeration industries. This approach abandons the scientist's desire for high efficiency and advanced technical performance, in favor of the investment community's criterion of product low-cost and high rate-f-return on investment.

Thus, in accordance with embodiments of the invention, the path taken is to seek systems which offer high economic performance at low cost. This means simple systems, and equipment of modest performance, derived from a large volume manufactured industrial base. The major hardware portions (flat plate collectors, heater-vaporizer heat exchanger, pumps, valves etc.) of the AutoSolar Thermal Electric Conversion (ASTEC) solar power system described herein requires no R&D; rather already existing technologies and equipment from the world of heavy manufacturing are utilized.

The ASTEC system utilized, in part, the hundred year old Rankine cycle. Rankine cycles use a working fluid, vaporized in a heater, to drive an expansion engine producing shaft power, then condensed in a condenser heat exchanger, and pumped back at higher pressure back to the heater. The shaft power turns a generator for electrical power output. The heater is supplied with thermal energy from a solar energy collector system, and waste heat is removed from the condenser by rejection to ambient air.

The most reliable and lowest cost expansion engine in the world is the automotive engine, manufactured in the tens of millions each year. Because of this, auto engines have the least costly swept volume of any heat-power engine on the planet. Heater and condenser heat exchangers are also least costly from the auto industry. Both functions for the low-cost ASTEC system can be served by the multi-million manufactured auto engine radiators, which are the cheapest heat exchangers (per unit heat transferred) in the world. This leaves only the solar collector system.

Collectors are fabricated at low cost from the mass-manufactured back plates which reject heat in (older) conventional refrigeration systems. These form the main collection elements in the complete collector unit, which uses double pane thin-glass covers, modest back insulation and mounting in a low-cost wood frame box. The fluid to be used in the collector plates may be either water or a standard heat transfer oil (e.g. Dowtherm A). Thermal energy storage, to allow system power generation during dark time (night), can be provided at very low cost by use of the cooling fluid (e.g. water) stored in a simple insulated tank, which supplies heated fluid to the Rankine cycle fluid heater radiators.

The optimum fluid for the Rankine expansion cycle circuit through the expansion engine is the modern replacement for Freon refrigerant (e.g. R-123 vs Freon-11, etc). If water is used in the collector circuit, the entire cycle operates only between the upper temperature limit of about 210 F in the heater, and a lowest temperature of 60 F (winter) to 100 F (summer) in the condenser heat exchanger. In this temperature range, and with the appropriate refrigerant working fluids, the system heater pressure will not exceed 200–240 psia at engine inlet, and the lower pressure at engine exhaust can be kept below 22–25 psia. Because of these low temperatures and pressures, virtually no wear will occur on the equipment, whose lifetime is thus measured in decades, as for conventional refrigeration systems.

While the overall efficiency of utilization of solar energy is also low because of these low temperatures, the extremely low cost of the equipment, and of the assembled system, leads to low-cost for the output power. The cost of this solar thermal conversion power plant is determined by the costs of its equipment and systems components, and by the cost of their assembly and field installation. The system/equipment costs arise principally from its two main subsystems. These are:

1. The thermal conversion system, including all heat exchange elements.
2. The solar collector system that acquires energy during the day and the thermal energy storage system that provides energy during night time.

Additional costs will be accrued for electrical power generation, controls, switching, pumps, valves, piping, system housing and other miscellaneous items. Thus costs must be accounted for:

3. The main electrical generator system, controls, switchgear, power line interfacing.
4. The flow pumps, piping and controls
5. A protective building for engine/generator and waste heat radiator subsystems.

Of these, the dominant cost is that of the collector system. This results directly from the fact that the solar insolation (power flux and fluence) falling on the Earth's surface is diffuse and relatively weak, being about 1.34 kWth/$m^2$ on the top of the atmosphere at the subsolar point.

BRIEF DESCRIPTION OF THE DRAWINGS

FIGS. 10–12 show working fluid flows through various arrangements of solar panels.

FIGS. 13 and 14 show cross sectional views of solar panels according to embodiments of the invention.

DETAIL DESCRIPTION OF PREFERRED EMBODIMENTS

Solar Insolation, Absorption and Capture Efficiency

Data have been taken over many years for solar insolation in the US. It has been found that areas with the highest solar flux/fluence are in the Southwest, including Southern California, Arizona, New. Mexico and parts of Texas. Here, measurements show that the total solar energy fluence ($F_o$) incident on a surface perpendicular (normal) to the sun during the daylight hours (requires turning the incident surface to make this measurement) varies from about $F_0$=10 kWthhrs/m$^2$ in the summer (June) months to $_{F0}$=5 k Wthhrs/m$^2$ in the winter (December). For design purposes for the ASTEC system solar power system, the average normal summer insolation has been taken as Fos=9.6 kWthhr/rn2 and that in the winter as Fow=4.8 kWthhr/m$^2$.

Realistic economic considerations make tracking collectors impractical, as the increased collection achieved is generally not worth the considerable cost of the tracking and mounting systems, flexible piping, etc. The ASTEC system of interest here is thus limited to use of flat plate collectors that do not turn to follow the sun. However, it is easy, cheap and practical to mount these fixed collectors so as to face the sun at high noon, and thus to capture the maximum amount of sunshine during the day without moving. For such collectors, the total solar energy that can be collected will then vary significantly from sunrise to sunset. At these two extremes, no sunshine will be collected. As the sun is higher above the horizon, it "sees" more and more of the collector surface, which is then heated higher with increasing sun angle. However, the effective absorption of the collector surface also varies with sun angle, being less at small angles and more at normal incidence. The absorption coefficient varies about as the sine of the sun angle. And the solar flux incident on a fixed normal-at-noon collector also varies as the sine of the sun angle. The result of these two variations is that the collected solar flux varies as the square of the sine of the sun angle. The solar flux can thus be written as a function of the hour of the day (t, in 24 hour clock system), for the angle in degrees, as $$f_{sol}=[Fo][\sin^2(15t)]\text{kWth/m}^2 \text{ for 6:00 am}<t<\text{6:00 pm}$$

Where $F_o$ is the total fluence for any given month-of the year, varying from the summer to winter values as discussed above. When this formula is examined over any given day, it is immediately seen that such a collector system will be practically useful only over about ¾ of the daylight hours, around noontime. The time spent with the sun below 30 degrees of the horizon does not contribute significantly to the total energy collected.

Although quite conservative, this formula has been used in the design of the ASTEC system collector system here. This means that the actual performance of the system will be somewhat better than the design values cited later for the complete system.

Rankine Cycles, Engine Expanders and Performance

Figure 1:
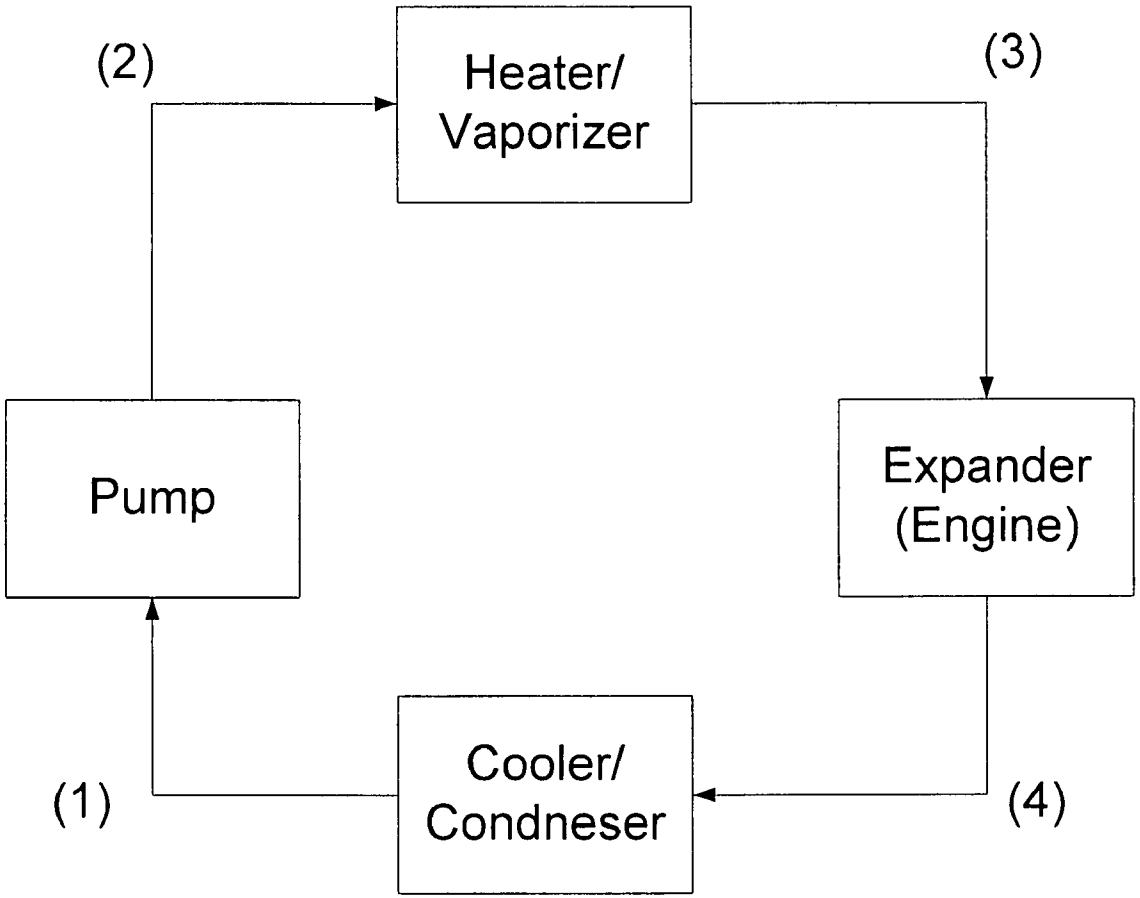
FIG. 1 shows an overall block diagram of the Rankine cycle utilized in embodiments of the invention.

The 125-year-old Rankine cycle is a very simple one. Its basic elements are shown in the schematic block diagram of FIG. 1. Here we see its principal elements as a pump, heater/vaporizer, expander (engine) and cooler/condenser, all acting on and from the working fluid that is flowing through the system. Cold, dense fluid at point (1) in the cycle is pumped to high pressure by point (2), and then vaporized in the heater/vaporizer between points (2) and (3), to arrive at point (3) as a high pressure gas. This gas is then expanded through the engine to point (4) making shaft power as it goes, and is then condensed in the cooler/condenser to return as dense liquid to point (1).

The efficiency of the Rankine cycle is just the ratio of the shaft power out to the total power into the fluid. The maximum possible power output from such a heat/power flow cycle is measured by the enthalpy (h) usefully extracted from the fluid in the cycle. Enthalpy is just the energy content per unit mass of fluid at any point in the system. The maximum efficiency of conversion is then just the ratio of the extracted enthalpy change in the expander, minus the enthalpy addition in the pump, divided by the total enthalpy change in the fluid from its highest value (at 3) to its low point (at 1). This is called the Carnot cycle efficiency.

The Carnot cycle efficiency is found to be simply the ratio of the maximum to minimum temperature difference to the maximum temperature in the flow system. This is $$\text{Efficiency}=\frac{\text{Shaft power out}}{\text{Total power in}}=\frac{(h3-h4)-(h2-h1)}{(h3-h1)}=1-(T_{cooler}/T_{heater})$$

The actual efficiency of this cycle will always be less than this expression, because of temperature differences in the heat exchange process in the heater and cooler, non isentropic pumping and expansion processes, losses at fluid intake and exhaust valving to and from the engine, and non-isothermal heat addition and extraction in the heat exchangers. All of these together generally reduce the efficiency below the Carnot cycle value, above, to a level of 0.7–0.8 of Carnot efficiency.

In accordance with some embodiments of the invention, the ASTEC power system is predicated on the use of fluid cycle temperatures so low that they can (a) be supplied by fixed flat plate collectors of very low cost (no high-tech), and (b) he used with refrigerant fluids in low temperature expansion cycle $$\text{Efficiency}=\frac{\text{Shaft power out}}{\text{Total power in}}=\frac{(h3-h4)-(h2-h1)}{(h3-h1)}=1-(T_{cooler}/T_{heater})$$

equipment with extremely long life and reliable performance, and of low-cost manufacture (no high pressures, or high temperatures involved). Thus, the range of upper fluid temperatures must lie from 300 degrees F. (for use of oil as heat transfer fluid in the collector system) to 200 degrees F.

(for use of water as the fluid in the collector system). The low heat rejection temperature of the power system will range from 60 degrees F. (in winter) to 100 degrees F. (in summer), for the lowest cost waste heat rejection to ambient air, using mass-produced auto radiators.

With these temperatures the Carnot efficiency will vary from 0.32–0.26 for the oil coolant, to 0.21–0.15 for the water coolant, over the winter and summer periods, respectively. Now, if the actual efficiency is only 0.75 of Carnot efficiency, then these cycle efficiencies will be reduced by 25% from the values above. The lower efficiencies occur in the summer, when the heat rejection temperature is highest, but also when the solar insolation is highest. These two effects compensate for each other, so that the effective output from a complete system is relatively independent of the time/season of the year in which it is running. For some embodiments of the ASTEC solar power system design, the efficiencies may be taken as 0.24 for oil use and 0.15 for water/collector/storage use.

A low-cost and reliable engine is that of the mass-produced Ford Tempo or Ranger, at 140 cubic inches of displacement, with four cylinders, and a compression ratio of about 8.5:1. The working fluid of interest is chosen from the acceptable refrigerant fluids which do not, harm the ozone in the atmosphere. These include R-134a, which acts much like earlier harmful Freon fluids, but has a molecular structure that does not break up atmospheric ozone. This or other similar fluids, e.g., R-123, may be used. With these, the upper temperature can be matched to the output of the collector field, whether with oil or water, and the lower temperature and pressure in the expansion process can be kept below 25 psia, with upper pressures in the range of 100–300 psia.

Detailed analyses of the fluid cycles shows that overall power output, with the above efficiencies can reach values of about 25 and 16.5 kW shaft power, respectively, when the engine is run at 2000 rpm in a Rankine-cycle mode as a pure low temperature expander system.

In accordance with embodiments of the invention, the valve timing of the engine is changed to give two-cycle operation. The exhaust valve is opened at the bottom of the cycle and kept open on the up stroke, while the intake valve is opened slightly before top dead center and held open as the piston goes over its topmost position, to allow high pressure driving fluid into the chamber. Since the intake pressure is high, the intake valve dwell time is small, while the exhaust valving is open on most of the cycle for the exhaust stroke. This change in valve timing is a minor correction achieved by replacement of the valve pushrod/lifter camshaft with one of proper action. An improved valving system may include rotary valves rather than push-rod-driven poppet valves, to reduce valve train drive power.

If the engine speed is increased, for example to 3600 rpm to match alternator/generator needs for 60 cycle electric power generation, then the engine power output will rise accordingly. Since parasitic loads (e.g. oil pumps, valve train power, etc) increase with speed, as well, the gain is not quite linear with speed increase. Thus at 3600 rpm this engine would be expected to yield about 40 and 26 kW shaft power, for collector oil and water temperatures respectively. Here, the design condition has been taken of only 15 kW electric output for a single-engine water collector system. This has the virtue that it is very conservative, and a considerable underestimate of system potential, thus—if this is economic—all other systems will be even more so.

For an engine producing 15 kWe at 0.16 overall efficiency, the thermal power that is needed to run the engine is 94 kwth. In the winter the daily solar fluence of 4.8 kWthhrs/m$^2$ leads to a requirement of $900/\epsilon_{col}$ square meters of collection area to acquire enough energy to run throughout the full 24 hours each day. Here Eco, is the energy collection efficiency of the solar collectors. Conventional flat plate collectors may provide $\epsilon_{col}\approx 0.5$, while the ASTEC system can reach $\epsilon_{col}\approx 0.75$ by use of its two tank approach to hot and cold storage. In winter, during the daytime, the energy collected is three times that used by the engine system; the rest is stored for night use. In the summer, the daily fluence is nearly twice as high, but the engine cycle overall efficiency is lower than in winter, by about ⅓. Thus, summer operation will give a potential output about 30% higher than in winter. For design purposes, a very conservative collector area of 1200 m$^2$ may be used with a collection efficiency of $\epsilon_{col}\sim 0.75$.

Solar Thermal Conversion Power System

The ASTEC solar power system has the advantage of providing a low cost system that employs mass-manufactured equipment (e.g. auto engine blocks converted to Rankine cycle expanders) and/or basic technologies (e.g. stamped sheet steel, seam-welded panel plates, analogous to mass-manufactured refrigerator back plane radiators) drawn from conventional production industries. These elements are assembled as the principal components of the unique configuration of the ASTEC system fluid flow, heating and cooling systems, to permit solar energy conversion processes at lowest possible cost.

The key to economic solar power is cost, not simply engineering efficiency. High efficiency systems traditionally cost a great deal more than those of low efficiency. However, if a low efficiency system can be made sufficiently cheaply, then its cost of power produced will be lower than that of the higher efficiency, but more expensive system. The unique approach here, in the ASTEC system, is to choose system components that are inherently low in cost, because they are designed to operate at low temperature and relatively unstressed conditions, thus eliminating any need for high technology in any of the system components. The low-cost technologies of interest here all are found in the heating, air conditioning and refrigeration industries, and in the automotive industry, and are derived from mass manufactured sources.

The ASTEC system consists of two main subsystems: One is the thermal energy collection and storage system (TCS), and the other is the thermal energy conversion (TEC) system. The two subsystems are physically distinct, in that the solar energy collected by the TCS system is stored in tanks of heated working fluid, independent of the TEC system. The TEC system uses this stored heated working fluid as the thermal power source to drive a heater-vaporizer for its expansion fluid cycle. The TEC system working fluid and flow system are coupled into the TCS system only through this heater-vaporizer. This permits the two subsystems to be designed and optimized independently for use of solar energy in the functions of each subsystem.

Figure 2:
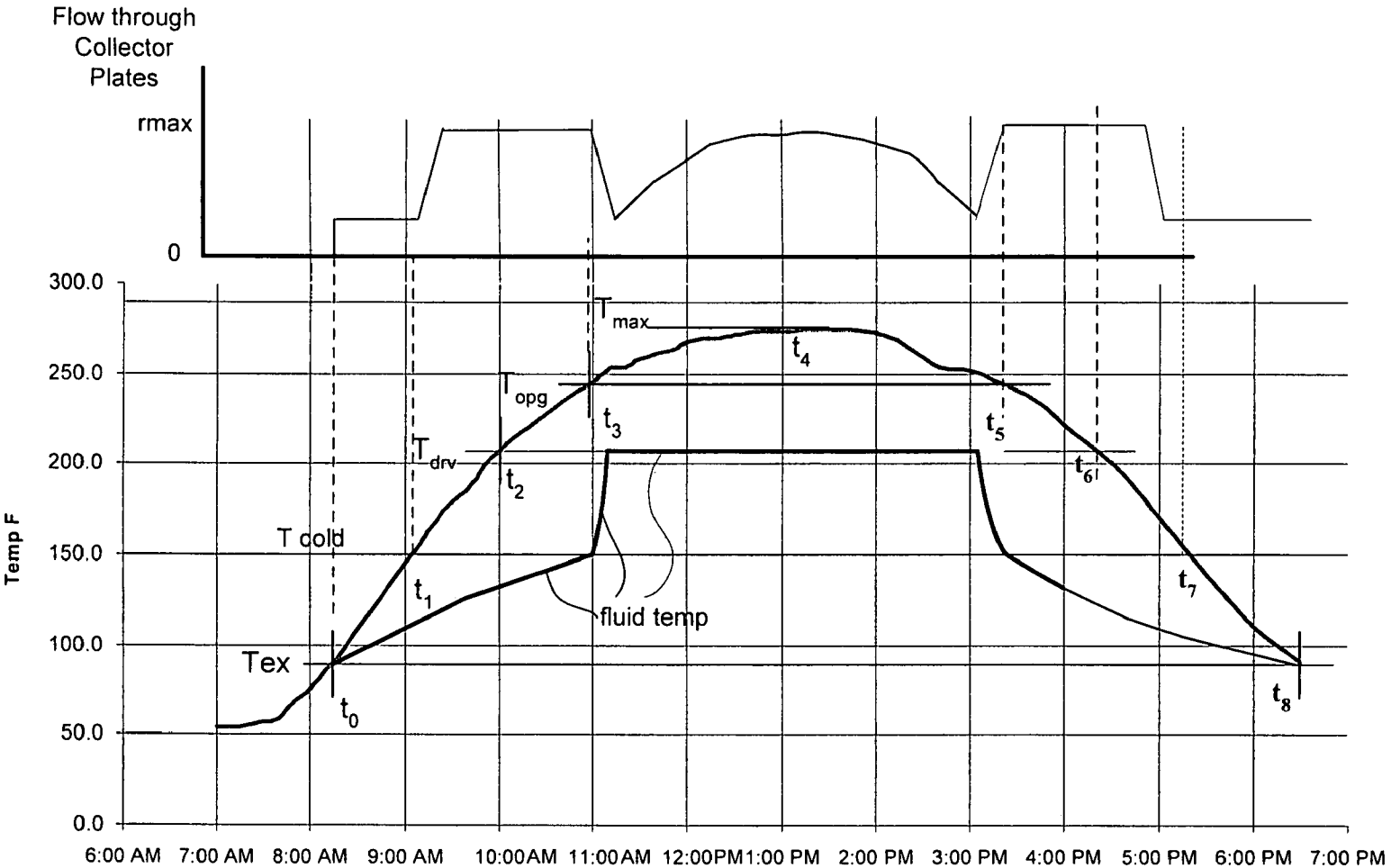
FIG. 2 shows a the (measured) performance of an ASTEC system collector panel operating without any cooling-working fluid.
Figure 3:
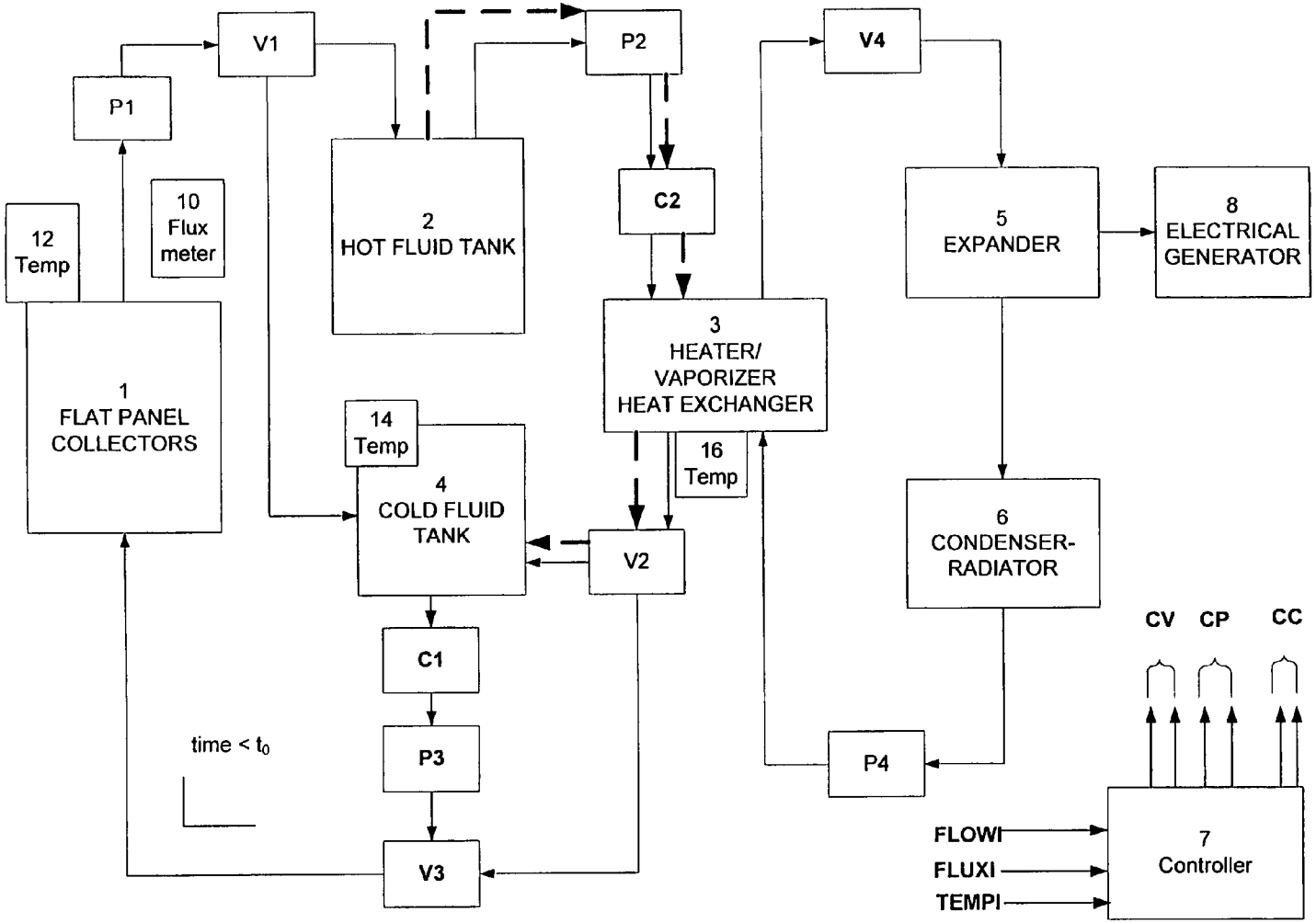
FIGS. 3–8 show block diagrams of the elements of the ASTEC system with the working fluid flow path shown during various times as depicted in FIG. 2.

The basis principles of operation of the ASTEC system according to embodiments of the invention may be understood in reference to FIGS. 2–8. FIG. 2 shows the temperature panel performance for an un-cooled panel and will be explained more below. FIG. 3 will be first described as representative of the hardware components depicted in each of FIGS. 2–8.

As shown in FIG. 3 there is provide one or more flat panel collectors 1, a hot fluid tank 2, a heater-vaporizer/heat exchanger 3, a cold tank 4, an expander 5 (e.g., engine), a condenser radiator 6, a controller, 7 and an electrical generator 8. The heater-vaporizer/heat exchanger 3 serves as a heat exchanger in the TCS system and as a heater-vaporizer in the TEC system. For simplicity, the heater-vaporizer/heat exchanger 3 will sometimes be referred to as the h/v 3 regardless of its function in either the TCS or TEC systems. Various pumps, P1, P2, P3, and P4 are provided as well as valves V1, V2, V3 and V4 as illustrated. For the TEC, the main pump 4 serves to pressurize the condensed working fluid from the condenser-radiators 6, and return it to the heater-vaporizer 3. The TEC system also uses valve V4 as a throttle valve for control of the flow system.

As illustrated in FIG. 3, there is also provided flow meter/controllers C I and C2 which measure the amount of fluid flow there through and control same (through a valve mechanism) in accordance with control signals input thereto. The flow meter/controllers C1 and C2 provide flow output signals (not shown) as flow input signals, FLOWI, to the controller 7. A flux meter 10 is also provided. The flux meter 10 is positioned away from and not in contact with the panel collectors 1, and measures the intensity of sunlight falling thereon and provides a flux output signal fed to the controller 7 as flux input signal FLUXI. The flux meter 10 is calibrated against a dummy un-cooled panel collector to provide a measure of un-cooled panel temperature as a function of incident flux. The calibration curve is stored in a memory contained in the controller 7. The controller 7 may then utilize the flux measurement provided by signal FLUXI to determine the temperature of an un-cooled panel collector. Alternatively, a temperature sensor may be used attached to a dummy panel to provide a temperature measure of the un-cooled panel. Further, both a flux meter and a temperature sensor may be used, one providing back-up measurements to the other.

There is further provided a temperature sensor 12 which measures the temperature of the working fluid leaving the panel collectors 1 and provides an output temperature signal which is fed to the controller 7. The temperature sensor 12 may be attached to the output flow conduit of the flat panel collectors 1. Further, temperature sensor 14 is provided to measure the temperature of the cold tank 4, and temperature sensor 16 is provided to measure the temperature at the output of the heater vaporizer heat exchanger 3. The temperature sensors 12, 14 and 16 provide inputs to the controller 7 and these inputs are shown collectively in FIGS. 3–8 as input TEMPI signals. The controller 7 receives flow input signals FLOWI from the flow meter/controllers C1 and C2; the flux input signals FLUXI from the flux meter 10; and the temperature signals TEMPI from the temperature sensor 12, 14 and 16 and uses these signals to control the TCS and TEC subsystems. The controller may be implemented by a digital processor and provides control signals CV, CP and CC to the valves, pumps and flow meter/controllers respectively to control same. The connection lines to the pumps, valves etc are not shown for simplicity. The algorithm which is implemented in the controller 7 will become apparent from the following detailed explanation of embodiments of the invention.

A further temperature sensor may be provided to measure the temperature of the hot fluid tank 2 to ensure that no overheating of the hot tank takes place.

As seen in FIG. 3, the TCS system includes a simple solar energy collector in the form of a one or more flat plate collectors 1, which heat the working fluid, which is then supplied to the hot fluid tank 2 and thence to the TEC system to vaporize the engine-expander working fluid, in the heater-vaporizer heat exchanger 3. The engine-expander working fluid then drives the expander 5 (modified engine described earlier), and is condensed in the low-cost condenser 6, which may preferably take the form of low cost radiators, and pumped back to the heater-vaporizer 3, and again heated by the TCS system working fluid. The TCS system working fluid, being thus cooled by its use in the heater-vaporizer is supplied either directly back to the solar collectors 1, or indirectly thereto, through a cold fluid storage tank 4.

A heater-vaporizer 3 is driven by the hot TCS working fluid from the hot tank 2, which flows in a counterflow fluid arrangement as compared to the flow of the TEC working fluid. The exhaust temperature of the TCS working fluid is only slightly (e.g. 5–1° F.) above the temperature of the condensed working fluid of the TEC system.

The expander 3 preferably takes the form a Rankine cycle engine expander supplied with the TEC working fluid vapor from the heat exchanger, which expands the TEC working fluid to low temperature (e.g. 80–100 F) and low pressure (e.g. 15–25 psia).

The TCS working fluid is typically water, but heat transfer oils may be used, although at greater cost. The solar collectors are typically mounted at a fixed co-latitude angle relative to the equator (in the northern hemisphere this is towards the south-facing horizon) and are fixed in position so that they point directly at the sun at solar noon-time. Preferably, the flat panel collectors 1 do not rotate, although this more costly option may be employed. The TEC system working fluid is typically, a refrigerant fluid (e.g. R-123), but organic hydrocarbons (e.g. butane, pentane) may be used, although at greater cost.

A major feature of embodiments of the ASTEC system is the TCS system flow configuration and flow control plan, developed so as to maximize the collection of solar energy, even during times when the sun is not high enough to drive the system directly.

To achieve high collection efficiency with a fixed, non-tracking flat plate collector system requires that as much as possible of the solar energy falling on the collectors be absorbed in the TCS system working fluid. In the ASTEC system, this is achieved by use of a dual-tank storage system for holding TCS system working fluid in varying amounts during the solar day.

The heater-vaporizer 3 is driven by working fluid at a temperature Tdrv which is desired for the drive system. This working fluid must always be taken from the hot working fluid tank 2 of the TCS system. During dark times, or in the early morning, if it is desired to drive the TEC system, it is necessary to have excess hot fluid stored in the hot tank 2 of the TCS system. Then, when the TEC system is running in the very early morning, for example, the output of the TCS system working fluid will be at the coldest temperature of the TCS system fluid cycle.

The basic principle of the ASTEC system is to collect solar energy in the early and late times of the day (when solar flux is too low to heat the working fluid to useful TEC system drive temperatures, Tdrv) by use of cold working fluid circulating from the heater-vaporizer 3 or cold tank 4, and returning to the cold tank 4, and then to switch to flow from the cold tank 4 and return to the hot tank 2 when the temperature capability of the collector panels exceeds the TEC system working drive temperature.

The operating principles set forth above are best described by reference to FIGS. 2–8. The (measured) performance of an ASTEC system collector panel operating without any cooling-working fluid is depicted in FIG. 2. Being un-cooled panels, FIG. 2 shows the maximum temperature that the panel can achieve as a function of time during the day. The data was taken on October 2002 in San Diego, Calif. and is representative of a dry sunny day in Southern California. The temperature vs time history is typical of such panels.

There are several points of time that are important for understanding the flow cycle control of the ASTEC system as shown in FIG. 2. Prior to time to, the un-cooled panel temperature (as measured by previously calibrated temperature correspondence with the flux measured by the flux meter 10) is below that the temperature of the fluid Tex being exhausted from the heater vaporizer 3. In this case, assuming that the TEC system is producing power, the working fluid of the TCS goes from the hot tank 2 through pump 2 flow meter-controller C2, heater vaporizer 3, valve V2 and into the cold tank 4 as shown by the heavy dotted lines of FIG. 3. No TCS working fluid flows to the panel collectors since the temperature of the panel collectors 1 is lower than the exit temperature Tex of the heater vaporizer 3.

Figure 4:
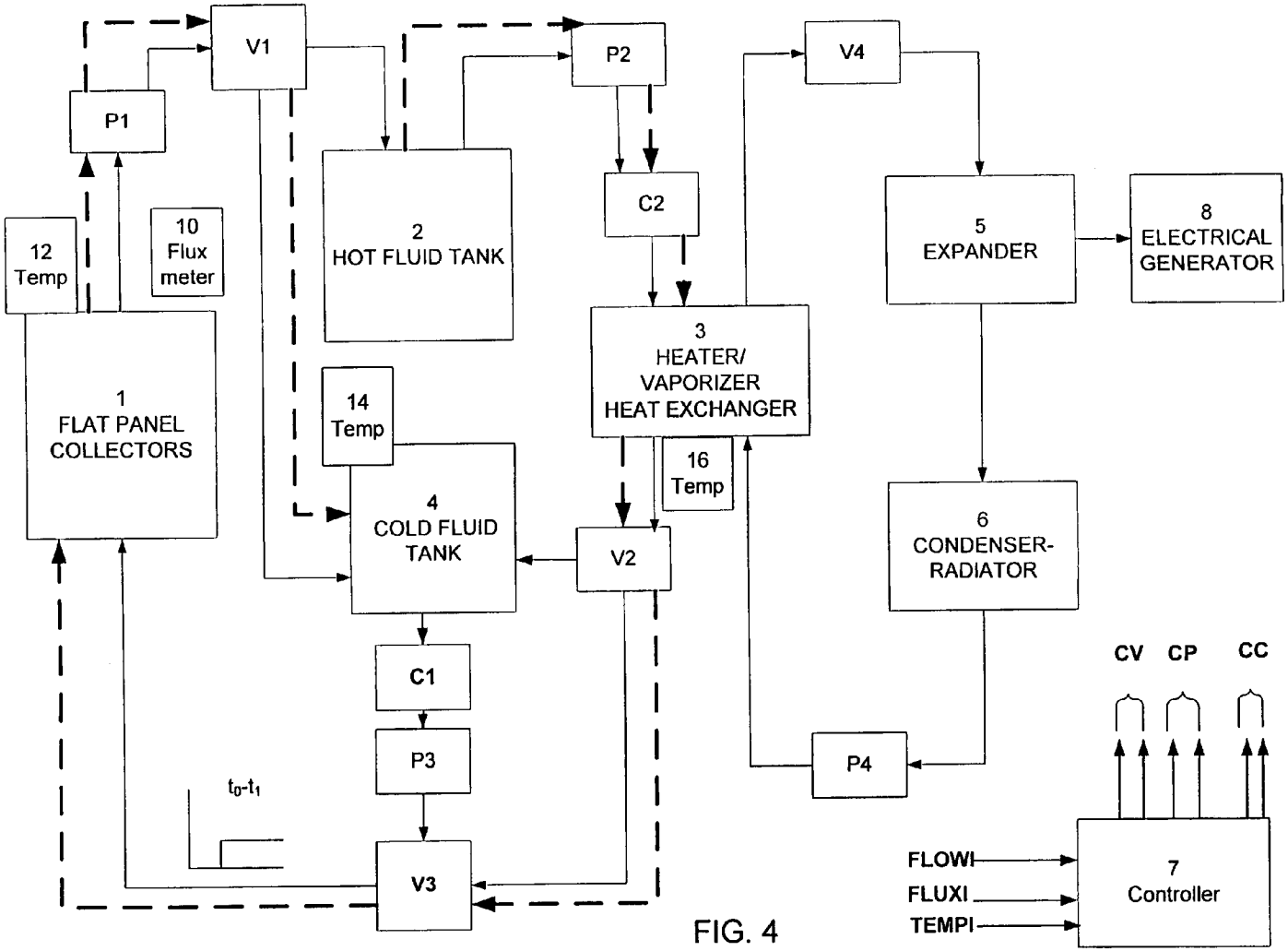

When the panel temperature, To, first reaches and exceeds the temperature of fluid Tex being exhausted from the heater-vaporizer 3, the TCS working fluid is delivered from the direct discharge of the heater-vaporizer (h/v) 3 to the panel collectors 1 through valve V2. This TCS working fluid emerges from the panel collectors 1 at a slightly higher temperature than its input temperature, limited by the temperature capability of the panel 1 heated by sunshine, and is returned to the cold tank 4. The path from the panel collectors I to the cold tank 4 is through the pump P1 and valve V1, and the complete path is shown by the heavy dotted lines of FIG. 4. Also shown in FIG. 4 is a small graph adjacent valve V3 indicating the flow level during the time interval $t_0$–$t_1$.

FIG. 2 illustrates the time to at which the un-cooled panel temperature (as measured by the flux meter 10) crossed the heater vaporizer 3 exhaust temperature Tex. During this time, the TCS working fluid flow rises from zero as shown in the upper graph of FIG. 2. Also, the temperature of the TCS working fluid as measured at the output of the panel collectors begins to rise as shown in the line labeled "fluid temp" of FIG. 2.

Figure 5:
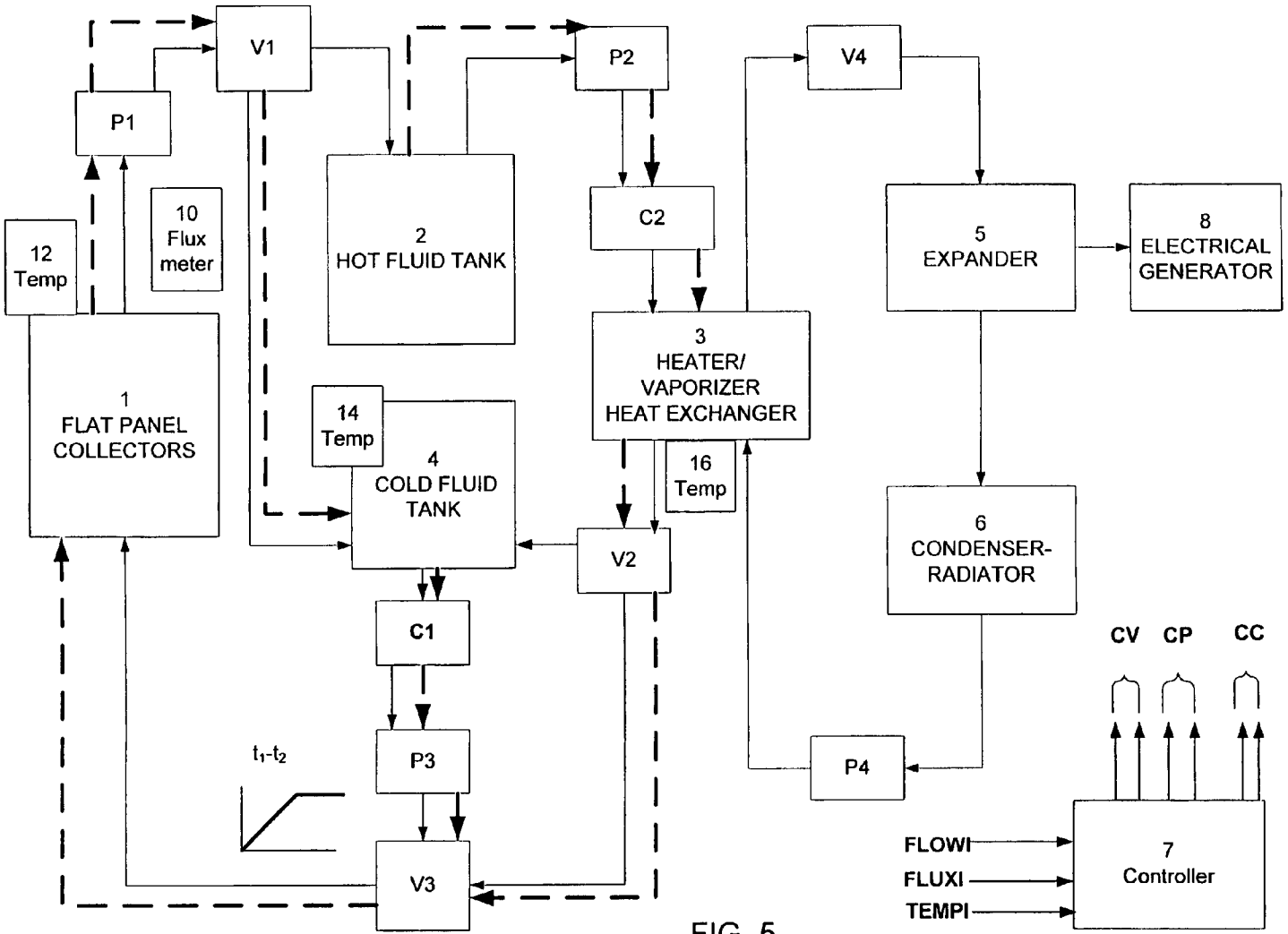

When the solar flux incident on the panels has become sufficient to heat the heater-vaporizer 3 exhaust fluid alone to a temperature above Tcold, the temperature of the cold tank 4, the valve V3 opens to allow cold fluid from the cold tank 4 to be added to the h/v 3 exhaust fluid to enter the collectors 1 as shown in FIG. 5. The amount of fluid from the cold tank to be mixed with the h/v exhaust fluid is controlled so as to make the total flow into the panels 1 preferably at but not higher than the maximum flow which is allowed for panel operation at high noon, when the solar flux input is at its maximum. This maximum allowable flow is set by design considerations of the maximum pressure drop allowed in the collector panels. It is generally in the range of 2–4 times the flow from the h/v exhaust alone. After ramp up of the total flow as shown in the upper graph of FIG. 2, (and also the lower left hand graph in FIG. 5), this total flow (and the mixing ratio) is held relatively constant during the time intervals $t_1$–$t_7$ as the sun rises and solar flux increases into the panels except for the period around $t_3$ as will be explained below. Thus the exit temperature of collector panel cooling fluid as measured by sensor 12 will rise as the sun rises. FIG. 2 shows the TCS working fluid temperature, "fluid temp" during the various times of the day and it may be seen to slowly rise during the time frame $t_1$–$t_2$.

Figure 6:
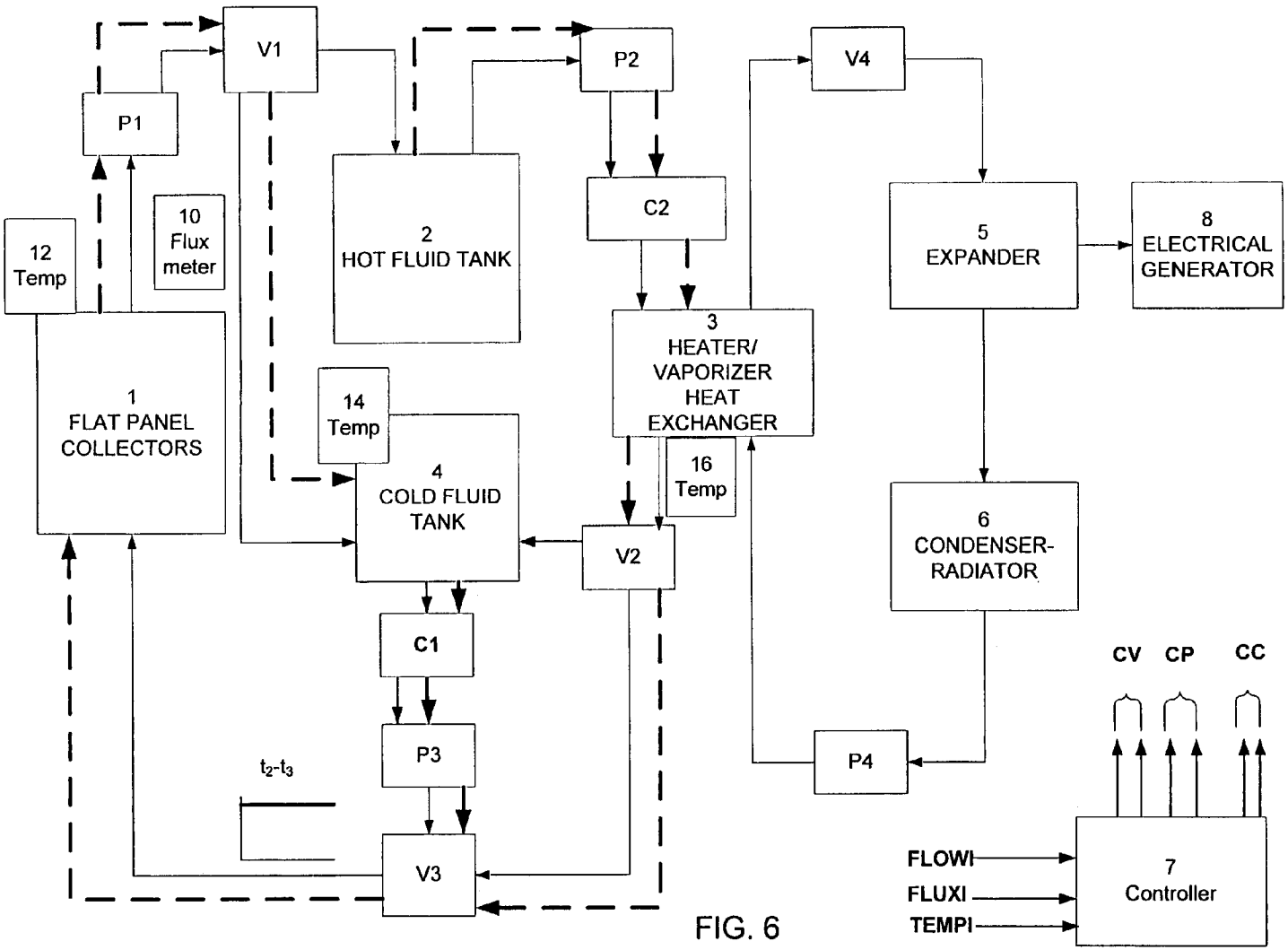
Figure 7:
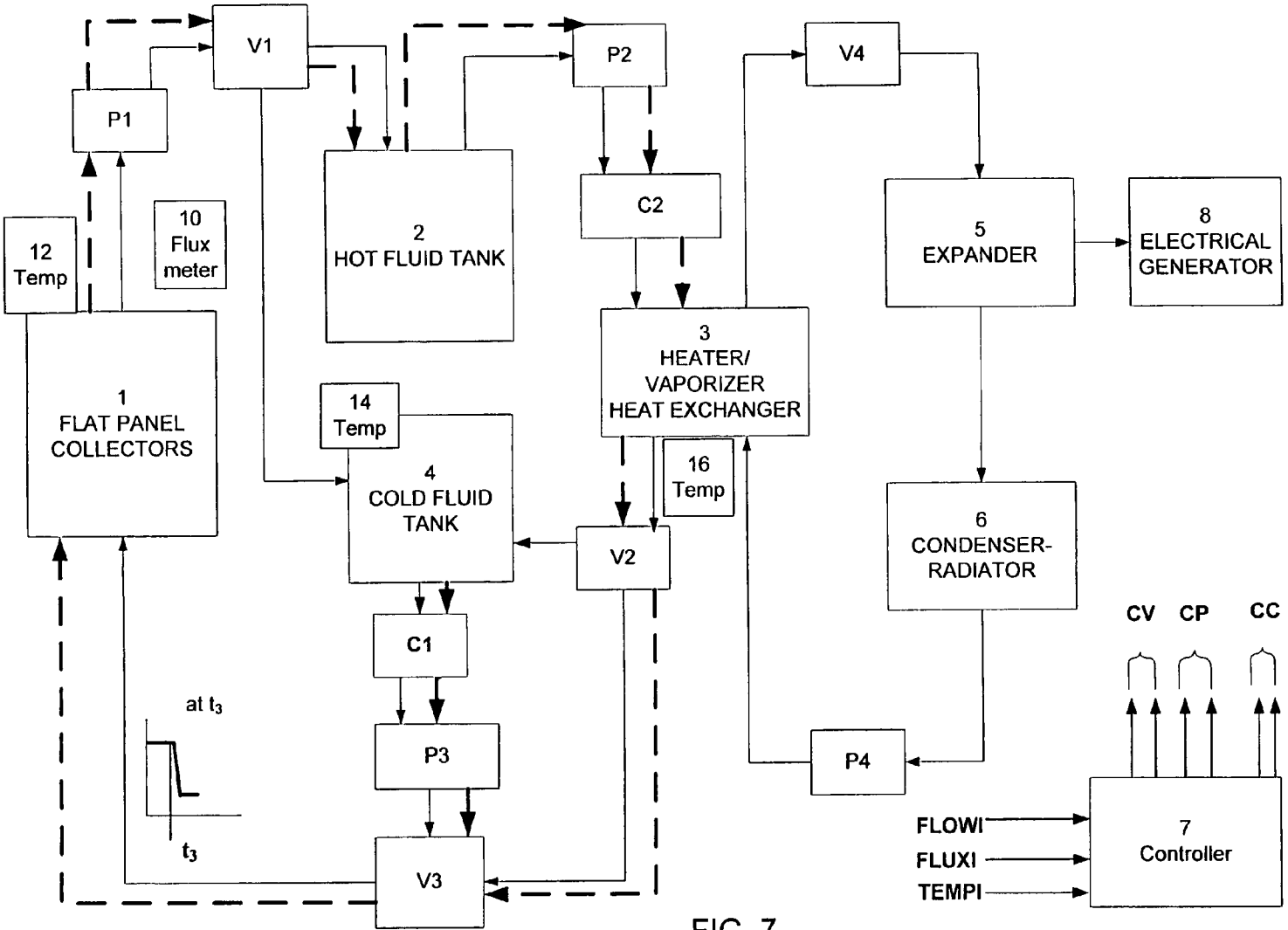
Figure 8:
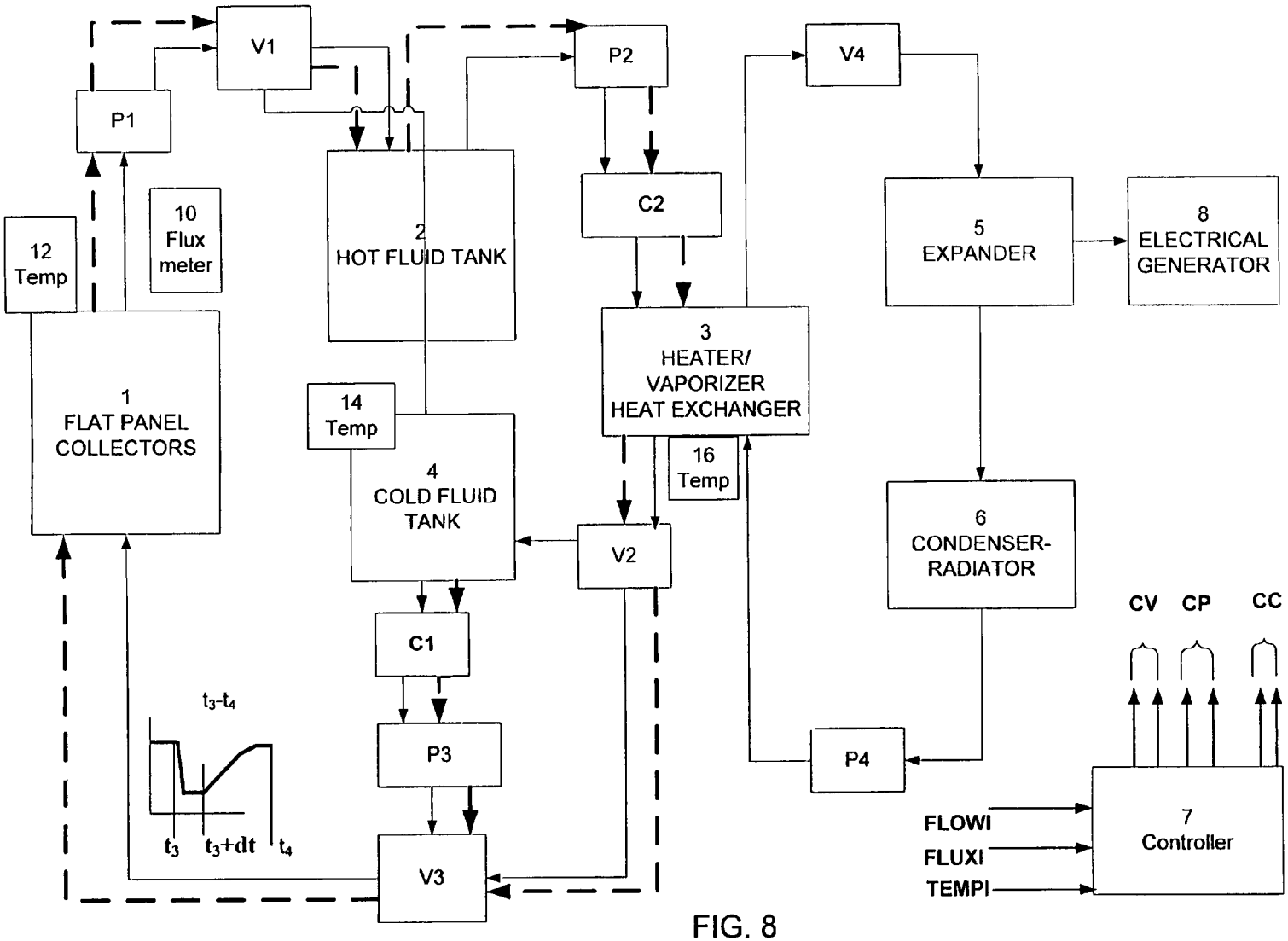

When the solar flux has reached that value at which the un-cooled panel would operate at the temperature, Tdrv, required for direct operation of the heater-vaporizer 3 in the TEC system, the panel cooling fluid flow could be reduced to provide fluid directly into the hot tank with a like amount of fluid taken out of the hot tank and fed to the h/v 3. However, since the flow thus obtained is less than that needed for fully direct hot tank flow operation of the engine system, (i.e., the flow rate is insufficient to drive the h/v3 with no net drain in the hot tank 2) it is more efficient, in terms of collector efficiency, to continue running the maximum flow from the cold tank 4 through the collectors 1, with collector panel exit flow continuing to be returned to the cold tank 4. This cycle is chosen in that it is more efficient to run cooler working fluid through the panel collectors 1 than warmer working fluid and to maximize the amount of cooler working fluid through the panel collectors 1. Thus, the collector exit temperature of the working fluid will continue to remain below that of Tdrv during the time interval $t_2$–$t_3$. FIG. 6 shows the same flow path as shown in FIG. 5, but the graph at the lower left corner of FIG. 6 indicates a constant and maximum fluid flow going into the panel collectors 1. FIG. 2 also shows this constant maximum fluid flow in the top graph, and it is also seen that the fluid temperature of the TCS working fluid continues to rise during this time interval $t_2$–$t_3$. This rise in TCS working fluid is important since high flow rates are maintained in this time interval and cool working fluid is utilized. Thus the TCS working fluid may extract thermal energy from the heated solar panel in a highly efficient manner.

Now, as the sun continues to rise and the solar flux input increases, the panel will reach a condition at which its un-cooled panel temperature, as measured by flux meter 10, is considerably higher than that for system drive, called Topg (operating temperature). At this time, the TCS working fluid to the panel collectors 1 is reduced by partially closing off the valve mechanism within the flow meter/controllers C1 as determined by the controller 7 to result in a total TCS working fluid flow sufficient solely to satisfy the requirements of the engine system drive. Reduction in the TCS working fluid flow results in the TCS working fluid temperature exiting the panel collector 1 rising to reach the temperature Tdrv as shown in FIG. 2 by the line fluid temp. During the time frame $t_3$–$t_5$, after the flow drops near the time $t_3$, the total flow gradually increases in a manner to maintain the fluid temperature of the TCS working fluid at Tdrv. Thus, gradually, between $t_3$ and $t_4$, working fluid from the cold tank 4 is increasingly added to the exhaust working fluid of the h/v 3 in the valve V3 and fed to the panel collectors 1. For a TCS working fluid of water, Tdrv would be near the water boiling point. FIG. 2 depicts in the upper graph the drop in the TCS working fluid flow rate at time $t_3$, and this drop is also depicted in the lower left graph of FIG. 7. When the temperature of the working fluid (as measure by temperature detector 12) reaches Tdrv, the working fluid is now, for the first time during the day, delivered to the hot tank 2 as shown by the heavy dotted lines of FIG. 7.

As the sun continues to rise from $t_3$ to $t_4$, the solar flux raises beyond Topg to the peak un-cooled temperature point at Tmax at time $t_4$. At 1300 hours, the TCS working fluid flow is again at its maximum allowable value, and TCS working fluid which is heated thereby to Tdrv, beyond the time of the Topg point, in excess of that needed to power the engine system, is then stored in the hot tank 2, thus refilling the hot tank 2 for future use.

When the solar flux reaches its maximum at 1300 hours (time $t_4$ which is the un-cooled Tmax point), the flow control process is simply reversed from that just described, from $t_0$–$t_4$. Now, as the sun goes down, the panel flow gradually decreases until just before the point at which the Torg is reached where the flow is decreased to where the flow would exactly equal that required to drive the engine system. As the un-cooled panel temperature approaches Torg, the flow is again increased steeply, with fluid added from the cold tank 4 mixed with the h/v 3 exhaust fluid. At this time $t_5$, the working fluid temperature leaving the panel collectors 1 begins to drop below Tdrv, thus again increasing panel collection efficiency. TCS working fluid exiting the panel collectors is again now discharged to the cold tank 4, and the engine system now is running on the stored fluid in the hot tank, at Tdrv.

The remaining operation from $t_5$–$t_8$ is simply the reverse of the operation during the period $t_0$–$t_3$, and the graph shown in FIG. 2 is seen to be symmetrical for the sunrise and sunset portions.

To reiterate some of the above points, during the morning hours, by the time that the system has reached the un-cooled Topg time, the hot tank 2 has been depleted or nearly depleted by operation during the evening, night and perhaps dark morning time of day. At un-cooled time Torg, the hot tank 2 is finally able to begin being refilled. The fluid emerging from the collector panels 1 at Tdrv is not enough to fully supply the heater-vaporizer of the TEC system, however, until such time t3 as the (un-cooled) panel temperature capability has reached the temperature Topg on the graph of FIG. 2. At this time the solar flux is sufficient to supply all of the heater-vaporizer thermal power needs of the TEC system. Keeping the panels colder than Tdrv until this time (time $t_0$–$t_3$), by use of excess cooling fluid flow, renders them more efficient as solar energy collectors.

In the above discussion, it is reiterated that the actual temperature of the TCS working fluid exiting from the panel collectors 1 will not be Topg shown on the FIG. 2, but will remain at Tdrv, throughout the time $t_3$–$t_5$. During the times $t_2$–$t_3$ and $t_5$–$t_6$, while the solar power flux is insufficient to drive the heater-vaporizer fully, the temperature is held below Tdrv by control of the flow of the TCS system working fluid, by its pumps and valves. These operations are done to gain efficiencies in extracting heat from the panel collectors 1.

Again, in reference to FIG. 2, once the un-cooled panel performance raises to reach the time shown for Topg, its un-cooled temperature plot will still rise above Topg. This means that the solar flux incident on the panel collectors 1 and able to be collected by the working fluid, exceeds that needed by the heater-vaporizer 3, as previously described (above). During this time period, $t_3$–$t_5$, the flow is adjusted (increased) so as to maintain the working fluid at the Tdrv temperatures, and all of the flow from the panel collectors 1 is fed into the hot tank 2. As already noted, the total flow rate during this time will be greater than that required by the heater-vaporizer 3.

By this means of use of dual tanks, appropriate sequencing of valving, and controlled variation of flow of the working fluid in the TCS system, it is possible to achieve much higher solar flux collection efficiency than with conventional, fixed, solar flat plate collectors which do not employ this flow valving, sequencing and control. Typically, collection efficiencies in the range of 65–75% efficiency may be obtained by these means.

Solar Collector System Size, Design, Storage and Deployment

Figure 9:
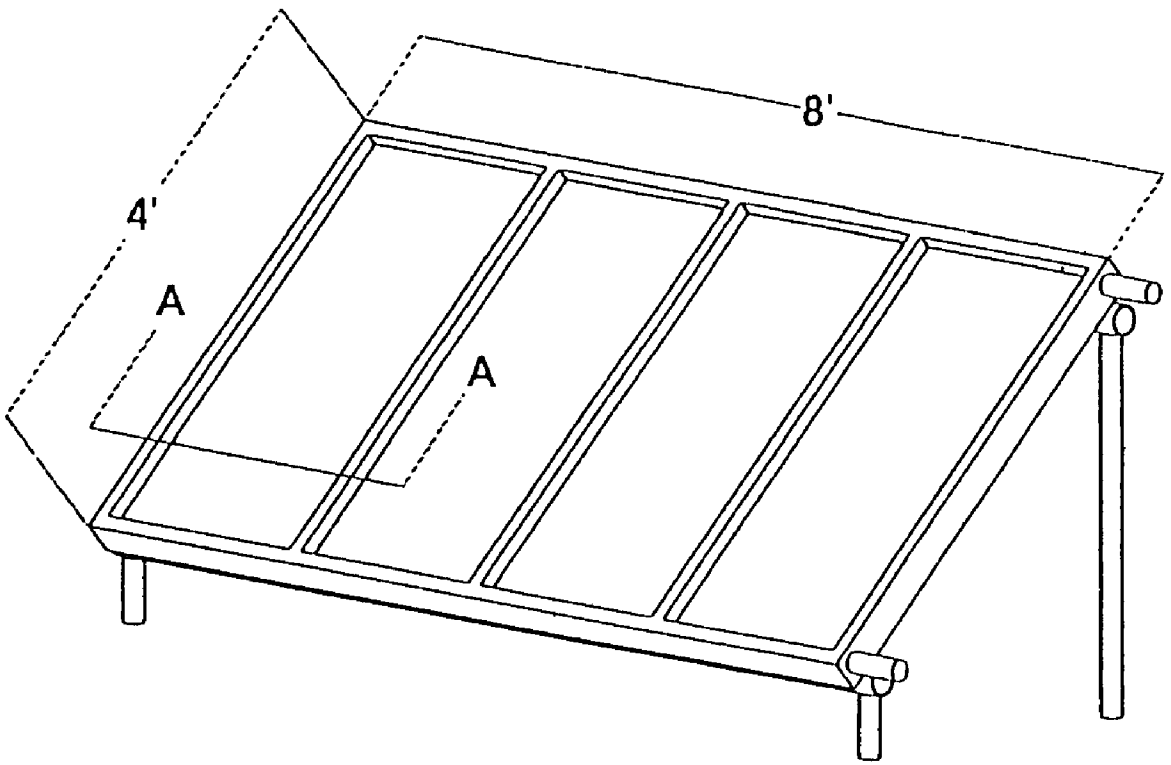
FIG. 9 shows an arrangement of one embodiment of a group of panels.
Figure 10:
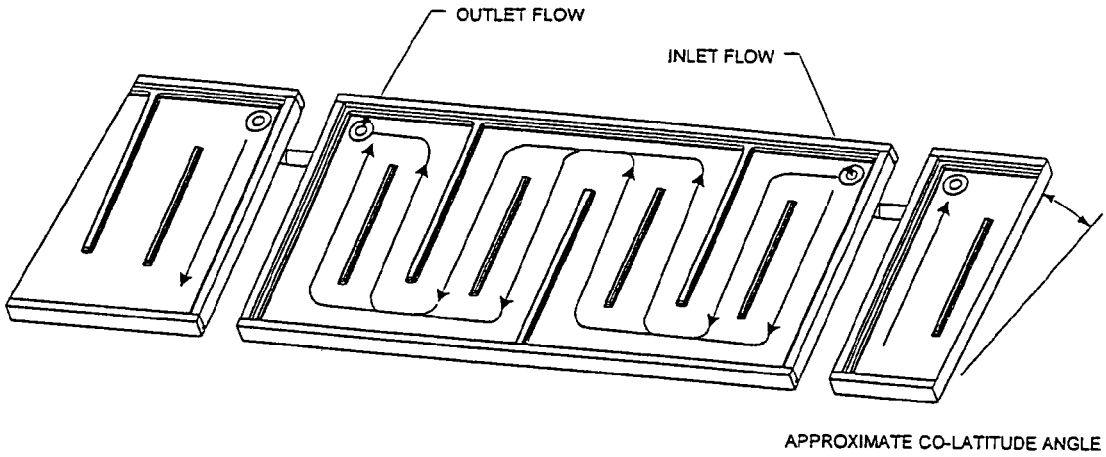
Figure 11:
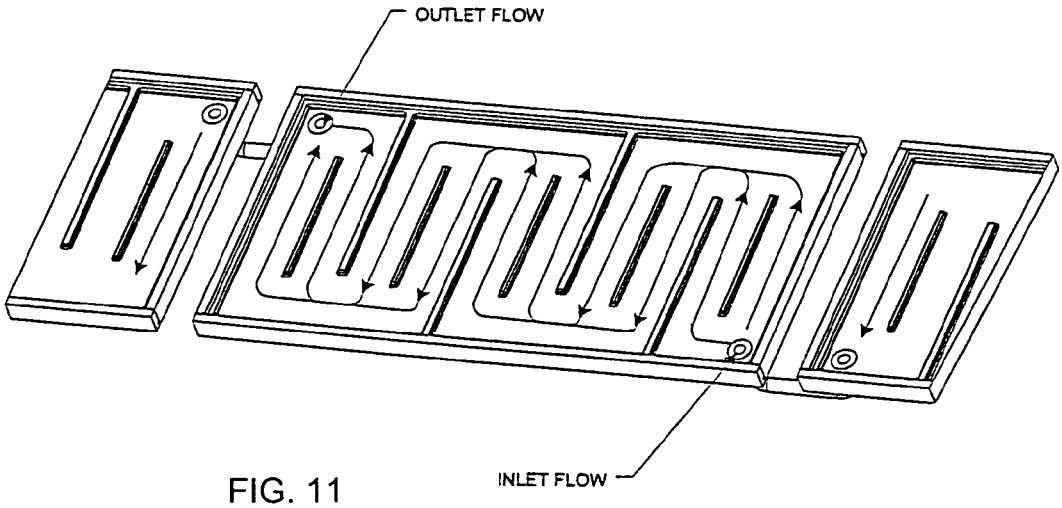

The plate collectors 1 are preferably designed for minimum cost manufacture, using mass-produced flat plate cooler panels originally designed and employed on refrigerators for coolant heat rejection to air. As a non-limiting example, these collectors 1 may be made in a size of approximately 2×4 feet, and thus fit as a module in a flat panel of 4×8 feet dimension. In a preferred embodiment as shown in FIG. 9, four plate panels are mounted side-by-side cross-wise on a 4×8 plywood sheet, on a layer of fiberglass insulation with foil backing facing the flat panel back surface. The set of four panels may be connected into a parallel flow system with merged inlet and output lines entering and leaving at one side of the plywood base as shown in FIGS. 9–12.

Figure 13:
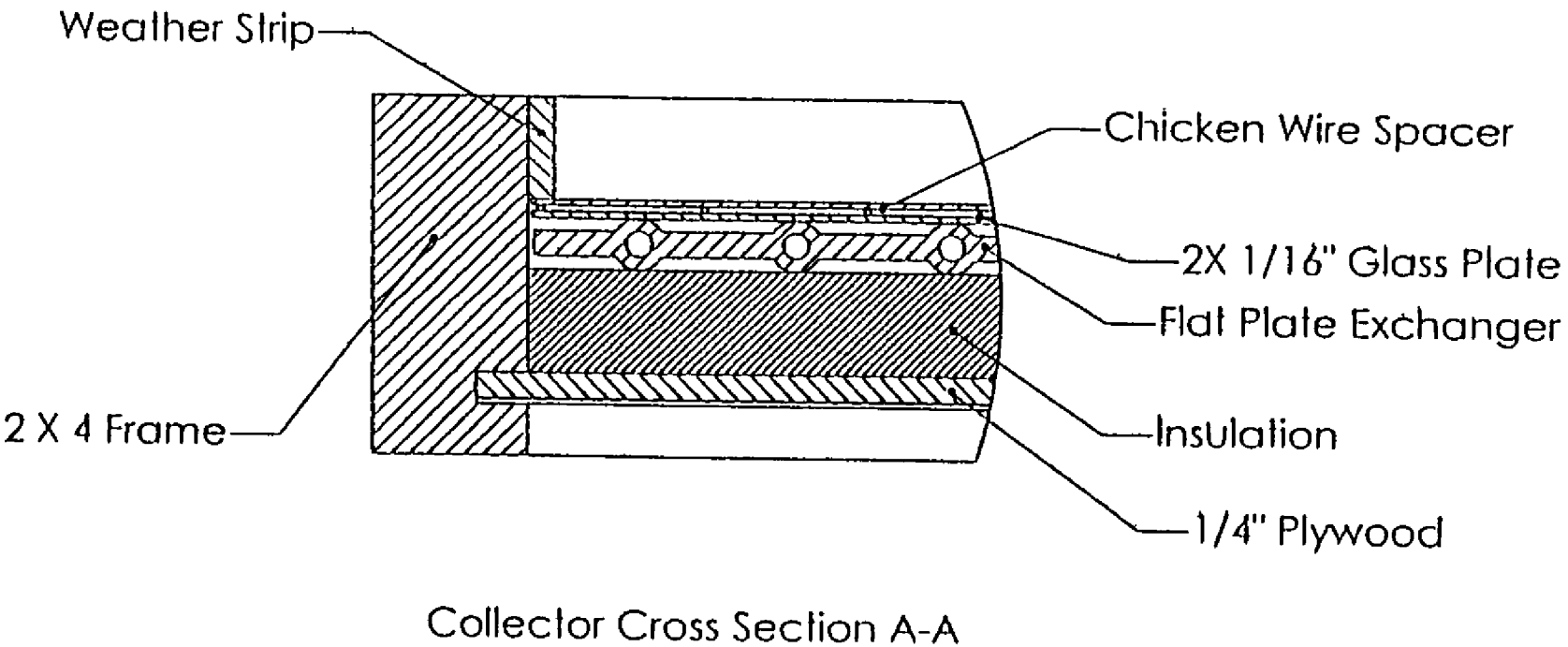

The plates are covered with one layer of 1/16 inch think glass, in sets of 2×4 ft sections, which are then covered with a second glass plate array, separated by a screen of chicken wire to produce air insulation space as shown in the cross-sections of FIGS. 13–14. The entire system is simply laid on the plywood base, within its 2"×4" wood side frame pieces, glued and nailed to the base plywood. The side 2×4's frame the entire collector panel.

The panels are mounted with the long side horizontal and the short side tilted at an angle to maximize solar collection. Each such full panel is fastened to a supporting 2 inch o.d. pipe frame, (or other lesser cost metal structural support) set in concrete and held to the pipe by 4 mild steel bolts, for easy field assembly. Each panel offers about 3.0 square meters of effective collector area, thus about 168 such panels are needed to give the total required collector area above. These can be arranged into 6 groups of 28 panels each, placed in a rectangular array around a building (shed) containing the engine, generator, controls, and thermal storage system and its heater and cooler heat exchangers. The panels are spaced normal to the solar noon line, so as to avoid losses due to panel/panel shadowing. This sort of modular solar power system could be replicated at large scale for higher total power output.

Figure 15:
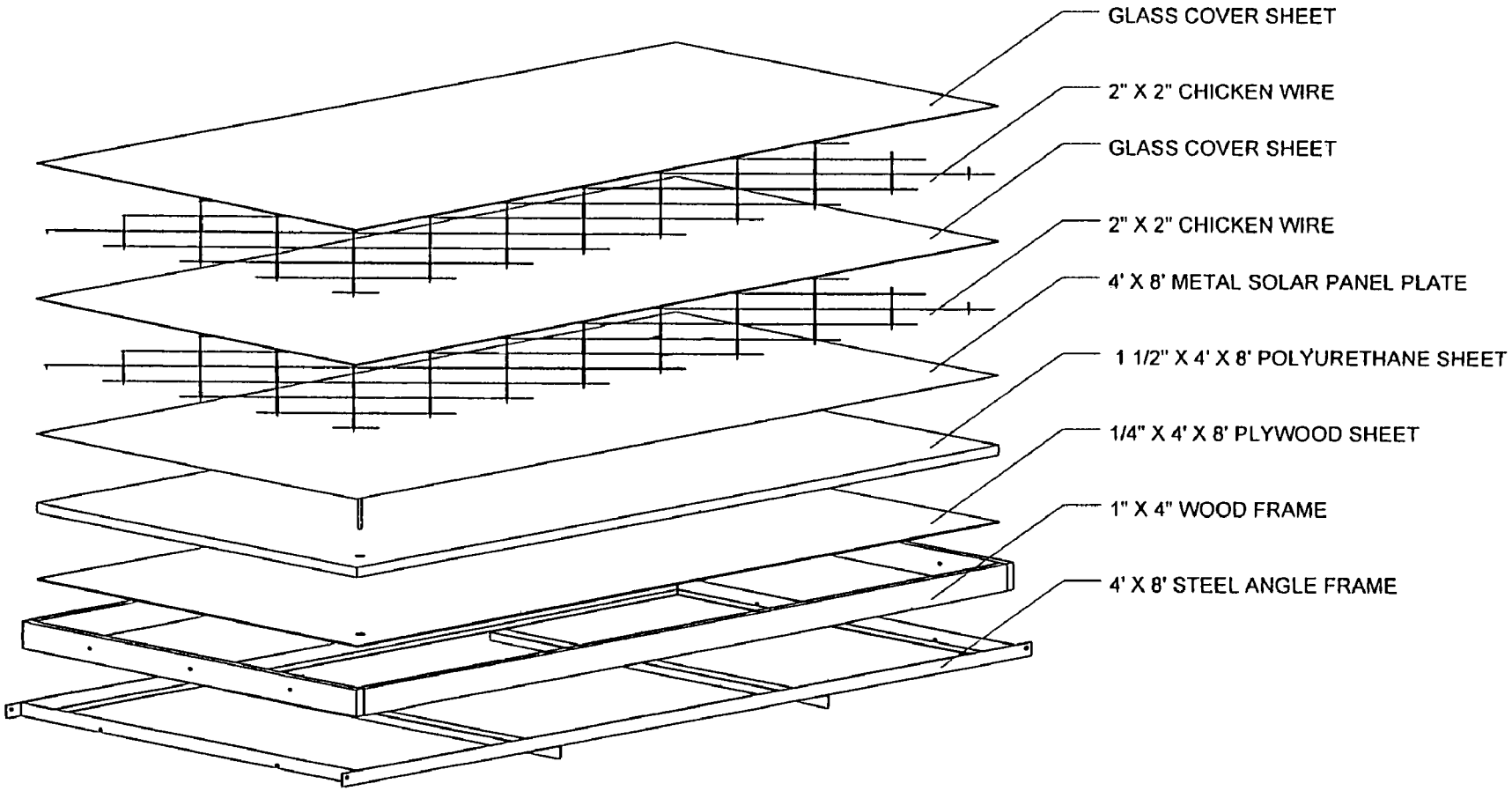
FIG. 15 shows an exploded view of a solar panel according to an embodiment of the invention.
Figure 16:
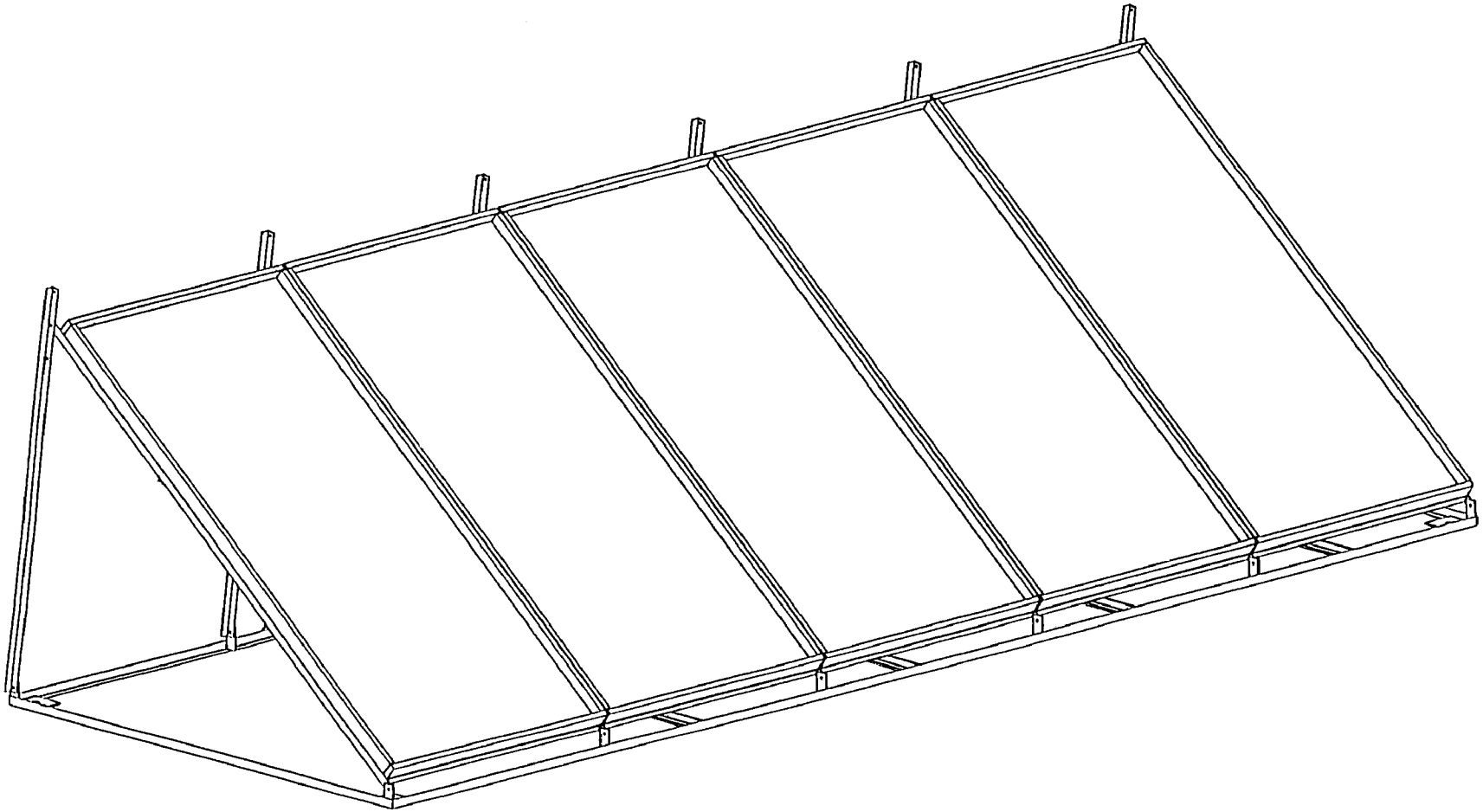
FIG. 16 shows an L shaped support bracket for a set of solar panels for supporting same an a fixed optimal inclination angle.

Alternative embodiments of the panel construction is shown in FIGS. 15 and 16. The L shaped frame structure of FIG. 16 supports 5 panels fabricated as shown in FIG. 15. In this embodiment, the solar panel plate may have the same or similar construction as that shown in FIGS. 10–13.

The storage system for both the hot tank 2 and cold tank 4 consist of simple insulated tanks. In one embodiment, the hot tank 2 may consist of a concrete-lined underground tank with a concrete roof and removable access port of reasonable dimension (e.g. 4×6 ft). This is cast into a hole excavated in a power conversion building area, and contains sufficient water (or oil) storage to provide power during the night hours with a temperature drop of less than 25 degrees F. The tank size may for example be a cube about 16 feet on a side.

In embodiments of the h/v 3, one may utilize a low-cost auto radiator, which is capable of transferring about 100 kwth in this fluid/fluid mode. The radiator may be mounted on a frame submerged in the upper portion of the storage fluid, and fluid is pumped through it by means of a submersible pump driving into a plenum chamber fastened to the radiator external frames. Alternatively, the radiator may be separate from the hot tank and in fluid communication therewith. Engine cycle fluid is pumped through the radiator, and heated by the storage fluid. The cycle cooler system is based on three auto radiators, each rejecting about 30 kwth to air. This is mounted above the tank in the power building, and cools the cycle fluid by forced convection to the ambient air (just as in automotive use). Electric power generated is fed to local transmission lines for delivery to the grid or to combine with other Auto Solar modules for higher grid power delivery.

Such a modular, simple set of components can be deployed by post-hole digging for the pipe frame supports, pumped concrete from cement trucks, on-site installation of the solar panel systems at the 4×8 ft size, and local hookup of inflow and outflow lines for the collector system to the storage tank. All main lines may be placed underground, with simple trenching burial, and can be made from high pressure PVC or other low-cost, temperature capable plastic pipe. Low-cost plastic valves can be used to isolate each panel from the common supply, for maintenance and replacement, and all pumping and main valves be kept in the power conversion building area. This building is a simple prefabricated steel shed building, to provide weather protection for the equipment. It is mounted on a concrete slab, poured as part of the floor for the underground storage tank. By these means, the costs of field installation can be kept to minimal levels.

System maintenance consists of four main items: (1) Thermal conversion system fluid condition and engine cycle operation; (2) Heater and cooler heat exchanger status and condition; (3) Collector/storage fluid condition and fill, and; (4) Solar collector system equipment and functioning status.

Since the system is composed of nearly failure-proof components and subsystems, and is operated at temperatures and pressures that ensure very long life, the maintenance level required is absolutely minimal. Engine cycle operation and thermal cycle fluid checking can be done in a matter of minutes, by simple observation and gage checking on the fluid lines. If leaks are occurring, these can be readily found, refills made, and seals replaced or otherwise fixed as required. Maintenance of the heat exchangers is determined by visual observation and inspection of their condition, and by temperature measurement using built in thermocouples on their inlet and outlet lines. If malfunctions are found, the exchangers may be replaced with new auto radiators, which is a simple operation. Collector/storage system fluid checking consists mainly of checking for piping leaks and testing for water chemistry adjustment, much like that required for swimming pools, but only at an interval of about one month for each 15 kWe module system. Makeup water can be added at this time, to adjust the fill level in the storage pool, as may be required. Finally, the simplicity of the collector panels argues for their low failure rate, and visual checking of cover plates, etc, should not be required more than twice each year.

Similarly, the inherent simplicity of each subsystem element of the system is such that fabrication and assembly of these sub-elements can be done very easily, quickly and cheaply. For a large scale installation, the engines will all be modified in a central shop, which will change the valve camshaft, and install a reconfigured head block. This is estimated to require no more that about 2 hours per engine. The collector panels are even easier, as they are assembled with fixed deliverable components, from scratch, using jigs and minimal hand labor. Collector flat panels are taped together, and laid into the side framed 4'×8' sheet plywood base, on a thin bed of fiberglass insulation. Each of the glass cover plates is then laid on to the flat panels, with the second sheet held off the first by a 4'×8' piece of cut chicken wire. The entire collector panel/glass "sandwich" is then held in place by weather strips fastened to the frame interior. Completed panels are then shipped to storage or the field. The wood frame pieces are all precut, drilled and slotted in a factory setup, before delivery to assembly.

The other subsystem elements, heat exchangers, pumps, generators, switchgear, valving, etc, are all quantity manufactured items and are shipped to assembly storage or to the field site for system assembly. Everything needed for field installation is prefabricated and delivered to the site in condition for immediate installation and use. Field operations then consist solely of equipment mounting, base construction (concrete tank, post supports, floors, and prefab building setup) collector panel, engine, generator and associated piping and wiring installation, and fluid line filling. Upon completion, the electrical output lines must be connected to the local grid and the system started up and set to run at minimal starting speed and/or power. This will require about 3–4 days of solar heating of the fluid system to establish the storage tank thermal capacity. After this time, the system can be set to run at any desired engine speed or electrical output, within its overall capabilities.

It is estimated that the unit plant module of the ASTEC solar power system, may be built for a specific power investment cost less than S1000/kWe at the 15 kWe level which is attained with only 200 degrees F. maximum temperature from the solar collector arrays. This is to be compared with the specific power cost of conventional oil, coal and gas-fired plants, which lie in the range of 1000–1500 S/kWe. And, of course, these plants have additional fuel costs during operation, while the ASTEC system plant does not. And, it is important to note that an easy upgrade to 300 degrees F. is possible by use of thermal oils instead of water in the collector system. This would raise the power output to about 25 kWe, and reduce all specific costs to about 60% of the values given above.

While embodiments of the invention have been described, it will be apparent to those of skill in the art that various modifications and substitutions may be made thereto and the invention is intended to cover all such modifications and substitutions that fall within the scope of the appended claims as may be understood from the forgoing written description.

What is claimed is:

1. A thermal collection system comprising:

a first tank for storing relatively hot working fluid, a second tank for storing relatively cold working fluid, a heat exchanger connected for receiving said relatively hot working fluid from said first tank for providing heat to said heat exchanger, said heat exchanger discharging said working fluid at a lower temperature than a temperature of said relatively hot working fluid of said first tank;

a solar collector connected for receiving the lower temperature working fluid from said heat exchanger, an intake side of said solar collector connected to said heat exchanger at least in a flow path independent of said second tank and for heating said lower temperature working fluid, heated working fluid output from said solar collector being fed to at least one of said first tank and said second tank;

said second tank having a control valve selectively operative for permitting working fluid from said second tank to flow to said solar collector.

2. The thermal collection system as recited in claim 1 wherein flow of said working fluid from said second tank through said control valve is controlled such that the total working fluid flow to said solar collector from both said second tank and said heat exchanger is maintained at a maximum value during a portion of the day in which a peak solar flux is incident on said solar collector and also during at least part of a non-peak portion of the day.

3. The thermal collection system as recited in claim 2 wherein said flow of said working fluid from said second tank through said control valve is controlled by means of a flow meter/controller connected in series with said control valve and which adjust the flow of working fluid therethrough.

4. The thermal collection system as recited in claim 2 wherein said maximum value corresponds to an un-cooled temperature capability of the solar collector.

5. The thermal collection system as recited in claim 1, wherein said first tank, said second tank, said heat exchanger, said control valve and said solar collector form a thermal energy collection and storage system (TCS), and said working fluid passing through said TCS is defined as a TCS working fluid; and wherein said heat exchanger is arranged in a thermal energy conversion (TEC) system comprising said heat exchanger serving as a heater-vaporizer, an expander, a condenser and a pump all connected in series, and a working fluid of said TEC, defined as a TEC working fluid, is heated by the TCS working fluid.

6. The thermal collection system as recited in claim 5, wherein said heater-vaporizer is driven by TCS working fluid from the first tank, with the TCS working fluid exhaust temperature is only slightly above the temperature of the condensed TEC working fluid.

7. The thermal collection system as recited in claim 6 where in the TCS working fluid exhaust temperature is 5–10 F above the temperature of the condensed TEC working fluid.

8. The thermal collection system as recited in claim 5 wherein said expander comprises a Rankine cycle engine expander supplied with said TEC working fluid vapor from the heater-vaporizer, which expands the TEC working fluid to low temperature and low pressure.

9. The thermal collection system as recited in claim 5 wherein said condenser takes the form of a condenser-radiator that condense the expanded TEC working fluid, being cooled by atmospheric air blown over heat transfer surfaces of said condenser-radiator.

10. The thermal collection system as recited in claim 5 wherein said condenser takes the form of a condenser-radiator that condense the expanded TEC working fluid, being cooled by cooling water.

11. The thermal collection system as recited in claim 5 wherein said pump pressurize the TEC working fluid exhausted from the condenser, and supplies it back to the heater-vaporizer.

12. The thermal collection system as recited in claim 1 further comprising a third control valve connected for selectively feeding working fluid from said heat exchanger to said second tank or to said solar collector.

13. The thermal collection system as recited in claim 1 further comprising a third control valve connected for selectively feeding working fluid from said heat exchanger to said second tank or to said solar collector through said control valve.

14. The thermal collection system as recited in claim 1, wherein:

said first tank, said second tank, said heat exchanger, said control valve and said solar collector form a thermal energy collection and storage system (TCS), and said working fluid passing through said TCS is defined as a TCS working fluid; and wherein solar flux thermal energy incident on said solar collector is removed by cooling from the TCS working fluid, said cooling accomplished at the maximum un-cooled temperature capability of the solar collector by control of the flow rate of the TCS working fluid into and through the solar collector.

15. The thermal collection system as recited in claim 5 wherein said first tank is filled from the working fluid exiting said solar collector when a temperature of said working fluid equals or exceeds a design operating temperature Tdrv for driving said heater-vaporizer of said TEC.

16. The thermal collection system as received in claim 15 wherein:

said expander comprises a Rankine cycle thermal conversion power system capable of turning an engine shaft, to drive an electrical generators;

said solar collector is fabricated in the form of a flat plate collector based on mass-manufactured refrigerator or refrigerator-derived flat-plate cooler plates, and said heat exchangers fabricated from mass-produced automotive radiators.

17. The thermal collection system as received in claim 16 wherein said first tank takes the form of an underground storage tank, formed as a concrete lined pool, into which said heat exchanger is submerged, to permit TCS working fluid of said heat exchanger to heat and vaporize the TEC working fluid.

18. The thermal collection system as received in claim 5 further comprising a plurality of solar collectors mounted on an L shaped bracket for supporting said collectors an a desired angle of inclination to permit solar light strike said collectors at a normal angle of incidence during peak flux portions of the day.

19. The thermal collection system as received in claim 1 further comprising a plurality of solar collectors mounted on an L shaped bracket for supporting said collectors an a desired angle of inclination to permit solar light strike said collectors at a normal angle of incidence during peak flux portions of the day.

20. The thermal collection system as received in claim 5 wherein said expander comprises at least one automotive engine such that the engine utilize the TEC working fluid to provide expansion fluid for driving a Rankine cycle.

21. The thermal collection system as received in claim 20 wherein said expander comprised a plurality of automobile engines.

22. The thermal collection system as received in claim 20 wherein said automobile engine is modified to have a valve timing to give two-cycle operation, wherein an exhaust valve of said engine is opened at the bottom of the cycle and kept open on the up stroke of said cycle, while an intake valve is opened slightly before top dead center and held open as a piston goes over its topmost position, to allow said TEC working fluid at high pressure into a piston chamber of said engine.

23. The thermal collection system as received in claim 5 wherein said condenser is formed by a plurality of automotive radiators.

24. The thermal collection system as received in claim 23 wherein said plurality of automotive radiators are cooled by fans blowing ambient air over radiator surfaces.

25. The thermal collection system as received in claim 24 wherein said heat exchanger is located submerged in said first tank.

26. The thermal collection system as received in claim 5 wherein said expander is in the form of an automobile engine having a drive shaft, and wherein said drive shaft is connected to an electrical generator for generating electricity.

27. A method of thermal collection comprising the steps of:

receiving said relatively hot working fluid from a first tank and for providing same to a heat exchanger, discharging said working fluid from the heat exchanger at a lower temperature than a temperature of said relatively hot working fluid from said first tank;

collecting solar energy in a solar collector connected for receiving the lower temperature working fluid from said heat exchanger;

heating said lower temperature working fluid in the solar collector;

feeding said heated working fluid from the solar collector to said first tank or to a second tank, containing working fluid at a lower temperature than said first tank; and feeding working fluid from said second tank to said solar collector;

feeding working fluid from said heat exchanger to an intake side of said solar collector at least in a flow path independent of said second tank.

28. A method of improving the efficiency of removing heat from a solar collector using a relatively hot and relatively cold working fluid pumped through the solar collector and comprising the steps of:

during early morning and late afternoon hours of the day, passing said relatively cold working fluid from a cold working fluid tank to said solar collector and returning the relatively cold working fluid, heated slightly by said solar collector to said cold working fluid tank;

during peak sunlight hours of the day, passing said relatively hot working fluid from a hot working fluid tank to a heat exchanger and then to an intake side of said solar collector at least in a flow path independent of said cold working fluid tank; and during said peak sunlight hours of the day, additionally passing said relatively cold working fluid to said solar collector together with said relatively hot working fluid.

29. The method of claim 28 wherein the step of additionally passing said relatively cold working fluid to said solar collector includes feeding said relatively cold working fluid to said solar collector at a variable rate which increases as a function of time while approaching a time of maximum solar flux, and decreases as a function of time when going away from said time of maximum solar flux.

30. The method of claim 29 further including the step of adjusting the amount of relatively cold working fluid fed to said solar collector in such a manner as to maintain the output temperature of the working fluid discharged from the solar collector at a maximal value.

31. A method of generating electricity comprising the steps of:

providing a thermal energy conversion (TEC) system comprising a heater/vaporizer, an expander, a condenser and a pump connected in series to pump TEC working fluid through said TEC system;

providing a thermal energy collection and storage system (TCS) comprising a solar collector, a hot TCS working fluid tank storing relatively hot TCS working fluid and a cold TCS working fluid tank storing relatively cold TCS working fluid, and a heat exchanger coupled to said heater/vaporizer of said TEC system;

during early morning and late afternoon hours of the day, passing said relatively cold TCS working fluid from said cold TCS working fluid tank to said solar collector and returning the relatively cold TCS working fluid, heated slightly by said solar collector to said cold TCS working fluid tank;

during peak sunlight hours of the day, passing said relatively hot TCS working fluid from said hot TCS working fluid tank to said heat exchanger and then to an intake side of said solar collector at least in a flow path independent of said cold TCS working fluid tank; and during said peak sunlight hours of the day, additionally passing said relatively cold TCS working fluid to said solar collector together with said relatively hot TCS working fluid;

heating said TEC working fluid in said heater/vaporizer of said TEC system by said TCS working fluid passing through said heat exchanger; and coupling an output of said expander to an electrical generator to produce electricity from operation of said TEC system.

32. The method as recited in claim 31 wherein the step of additionally passing said relatively cold TCS working fluid to said solar collector includes feeding said relatively cold TCS working fluid to said solar collector at a variable rate which increases as a function of time while approaching a time of maximum solar flux, and decreases as a function of time when going away from said time of maximum solar flux and further including the step of adjusting the amount of relatively cold TCS working fluid fed to said solar collector in such a manner as to maintain the output temperature of the TCS working fluid discharged from the solar collector at a maximal value.

* * * * *